US007530840B2

(12) United States Patent
Lund et al.

(10) Patent No.: US 7,530,840 B2
(45) Date of Patent: May 12, 2009

(54) MEDICAL SYSTEM INCLUDING A CABLE RETAINER

(75) Inventors: Peter A. Lund, Nashua, NH (US); Marc Cordaro, Sudbury, MA (US); Christopher Andrew Chang, Nashua, NH (US); Mark Baerenrodt, Milford, NH (US); Gary A. Freeman, Newton Center, MA (US)

(73) Assignee: ZOLL Medical Corporation, Chelmsford, MA (US)

( * ) Notice: Subject to any disclaimer, the term of this patent is extended or adjusted under 35 U.S.C. 154(b) by 0 days.

(21) Appl. No.: 11/055,007

(22) Filed: Feb. 10, 2005

(65) Prior Publication Data

US 2006/0178041 A1 Aug. 10, 2006

(51) Int. Cl.
*H01R 13/72* (2006.01)

(52) U.S. Cl. ..... 439/501

(58) Field of Classification Search ..... 439/501, 439/4, 719, 445, 447; 607/5, 1, 2; 191/12, 191/2 R; 206/338, 336; 248/51, 49, 68.1, 248/74.1, 52, 60, 74.3; 174/135, 35
See application file for complete search history.

(56) References Cited

U.S. PATENT DOCUMENTS

| | | | | |
|---|---|---|---|---|
| 2,721,624 | A * | 10/1955 | Osborn | 15/323 |
| 5,668,351 | A * | 9/1997 | Hanlon et al. | 174/68.3 |
| 5,775,935 | A * | 7/1998 | Barna | 439/488 |
| 6,087,594 | A * | 7/2000 | Chou | 174/135 |
| 6,427,290 | B1 * | 8/2002 | Liu | 24/16 R |
| 6,609,026 | B2 | 8/2003 | Salvatori et al. | |
| 6,695,490 | B2 * | 2/2004 | Shirakawa et al. | 385/86 |

FOREIGN PATENT DOCUMENTS

EP 921608 A1 * 6/1999

* cited by examiner

*Primary Examiner*—Felix O Figueroa
(74) *Attorney, Agent, or Firm*—Fish & Richardson P.C.

(57) ABSTRACT

In one aspect, a medical system includes a medical device having a housing, and a cable connectable to the housing; and a cable retainer associated with the medical device. The cable retainer has a constantly exposed opening maintained at a size sufficient to receive the cable in a bundled state.

32 Claims, 4 Drawing Sheets

MEDICAL SYSTEM INCLUDING A CABLE RETAINER

TECHNICAL FIELD

The invention relates to medical systems that include one or more cable retainers.

BACKGROUND

Certain medical devices, such as defibrillators, are capable of performing a therapeutic function, a monitoring function, or both. For example, a defibrillator can provide cardiac therapy by delivering defibrillation pulses and/or pacing pulses to a subject. The defibrillator may also provide a monitoring function by measuring certain vital signs of the subject and providing an indication of the measurements.

Today's external defibrillator may contain functions beyond the defibrillation shock, including external pacing, cardiopulmonary resuscitation (CPR) assistance via accelerometer, electrocardiogram (ECG) leads, and vital signs monitoring that includes oxygen (SpO2) monitoring, end tidal carbon dioxide (EtCO2) monitoring, blood pressure monitoring (non-invasive blood pressure monitoring (NIBP) and invasive blood pressure monitoring (IBP)) and temperature. Users of all of these functions, along with users of a subset of these functions often complain of the many individual cables that must be untangled to connect a patient to a defibrillator in an emergent situation. In this situation, the user is pressed for time and must connect the patient quickly to administer life-saving therapy. In addition, the user may often be involved in multiple tasks such as setting functions on the monitor-defibrillator as well as treating the patient and potentially communicating with a base hospital via cell phone or radio communications. This multi-tasking may result in the user having only one hand available to adjust the defibrillator and to handle the various cables.

Traditional stowage methods such as zippered bags attached to the side of the defibrillator have the limitation that they often result in tangling of cables and, when multiple cables are involved, additional entanglement with increased cable retrieval time. This is particularly a problem in the resuscitation situations for which the defibrillator is normally employed and for which every second of delay may adversely impact the survival of the patient. Conventional cable stowage solutions such as those described in U.S. Pat. No. 6,609,026 may require a number of standard pockets with door or flaps and zippers that are difficult to open and close with one hand.

Typically, a defibrillator includes a housing and one or more cables that are connectable to the housing. The housing contains the circuitry and other components of the defibrillator. The cables provide the interface between the housing and the subject during use. When not in use, the cables may be placed near the housing (e.g., on top of or next to the housing) so that they can be quickly accessed, particularly during an emergency situation.

SUMMARY

In a first aspect, the invention features a medical system, including a medical device having a housing, and a cable connectable to the housing; and a cable retainer associated with the medical device. The cable retainer has a constantly exposed opening maintained at a size sufficient to receive the cable in a bundled state.

Preferred implementations of this aspect of the invention may incorporate one or more of the following. The cable retainer is capable of deforming in shape to receive the cable. The cable retainer is configured to retain the cable. The cable retainer comprises a resilient material, such as a rubber or a thermoplastic elastomer. The cable retainer has a length to width aspect ratio greater than or equal to about 2:1, for example, from about 2:1 to about 8:1. The cable retainer further includes a second constantly exposed opening maintained at a size sufficient to receive the cable. The cable retainer has the form of a sleeve. The width of the opening is larger than another width of the cable retainer. The cable retainer is secured to the housing, e.g., releasably secured to the housing. The cable retainer includes a tubular member and a resilient material defining a cavity in the tubular member. The system further includes a compartment associated with the cable retainer. The compartment is secured to the cable retainer. The system includes a plurality of cable retainers associated with the medical device. The cable retainers includes indicia (e.g., a color code) corresponding to selected cables. The medical device is capable of performing cardiac defibrillation.

In a second aspect, the invention features a medical system including a medical device having a housing, and a cable connectable to the housing; and a cable retainer associated with the medical device. The cable retainer is capable of deforming in shape to receive the cable and having a length to width aspect ratio greater than 2:1.

Preferred implementations of this aspect of the invention may incorporate one or more of the following. The aspect ratio is from about 2:1 to about 8:1. The cable retainer includes a resilient material, such as a rubber or a thermoplastic elastomer. The cable retainer further includes a constantly exposed opening maintained at a size sufficient to receive the cable. The width of the opening is larger than another interior width of the cable retainer. The cable retainer is secured, e.g., releasably secured, to the housing. The system further includes a compartment associated with the cable retainer. The compartment is secured to the cable retainer. The cable retainer includes a tubular member and a resilient material defining a cavity in the tubular member. The system includes a plurality of cable retainers associated with the medical device. The cable retainers include indicia (e.g., a color coding) corresponding to selected cables. The medical device is capable of performing cardiac defibrillation. The cable retainer has the form of a sleeve.

Among the many advantages of the invention (some of which may be achieved only in some of its various aspects and implementations) are the following. The cable retainer can provide a medical system with a cable management system that facilitates stowage of one or more cables and reduces cable entanglement, which can occur, for example, when multiple cables are randomly placed in one storage compartment. Such entanglement may make it more difficult to locate and to use a desired cable and increase the time to deploy life saving functionality, thereby increasing the risk to the subject. The entanglement may also expose the cables to undue mechanical stress, which can shorten the life of the cables. For example, certain storage mechanisms can put repetitive stresses on a cable that reduces the life of the cable. Specifically, a cable that is wrapped up and stowed in a pouch can experience rotational stress when the cable is pulled out, and the stress may only be relieved if the cable is un-rotated manually, which may not normally be done as part of the cable deployment. The cable retainers described herein do not impart the rotational stress each time the cable is deployed.

In some implementations, the cable retainer features an opening that is constantly exposed and maintained at a size to receive one or more cables. The cable retainer does not include a closure (such as a zipper or a fastenable flap) that extends across an opening. As a result, the cable(s) can be efficiently stowed using one hand in one motion. The stowed cable(s) are clearly visible, readily accessible, and ready for deployment. Since they are organized and not tangled, the cable(s) can be efficiently deployed when needed using one hand in one motion, without the need to search or to untangle any cables.

At the same time, the cable retainer is designed to secure the cable efficiently. The size of the cable retainer has a length to width aspect ratio that firmly secures the cable and prevents the cable from flopping about or falling out, particularly when the medical system may be rapidly transported during an emergency situation. The design of the cable retainer, combined with the material from which the retainer is manufactured, are also selected to securely hold the cable while allowing convenient stowage and deployment.

Other features and advantages of the invention will be found in the detailed description, drawings, and claims.

DETAILED DESCRIPTION

Figure 1A:
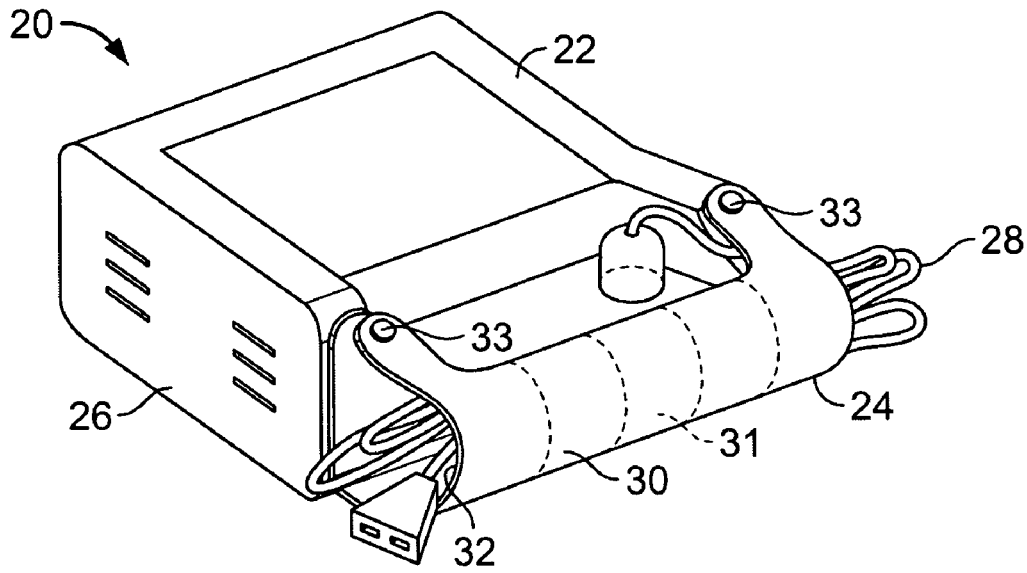
FIG. 1A is a perspective view of an implementation of a medical system having a cable in a cable retainer.
Figure 1B:
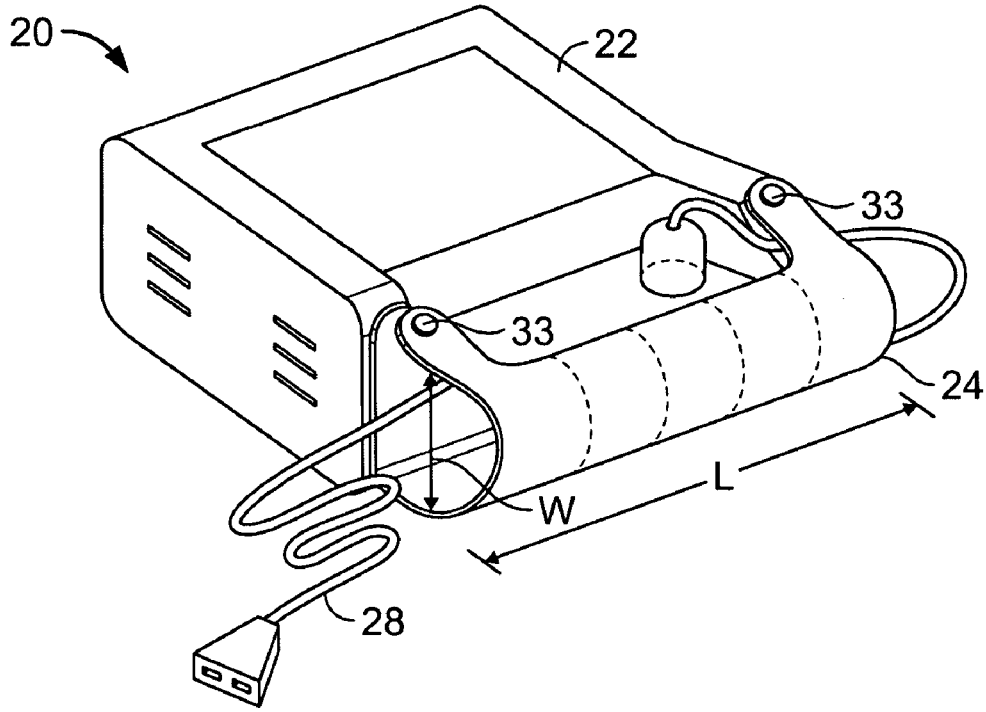
FIG. 1B is a perspective view of the medical system of FIG. 1A, with the cable deployed from the cable retainer.

There are a great many possible implementations of the invention, too many to describe herein. Some possible implementations that are presently preferred are described below. It cannot be emphasized too strongly, however, that these are descriptions of implementations of the invention, and not descriptions of the invention, which is not limited to the detailed implementations described in this section but is described in broader terms in the claims. Referring to FIGS. 1A and 1B, a medical system 20 includes a medical device 22 (such as a defibrillator) and a cable retainer 24 associated with the device. Medical device 22 includes a housing 26 that contains the circuitry and other components of the medical device, and a cable 28 that can be connected to the medical device to perform a therapeutic function and/or a monitoring function. As shown, cable retainer 24 is in the form of a sleeve and is secured directly to housing 26 by attachments 33, such as button snaps. Cable retainer 24 is configured to allow cable 28 to be easily stowed in the retainer and to be easily deployed from the retainer.

Figure 3:
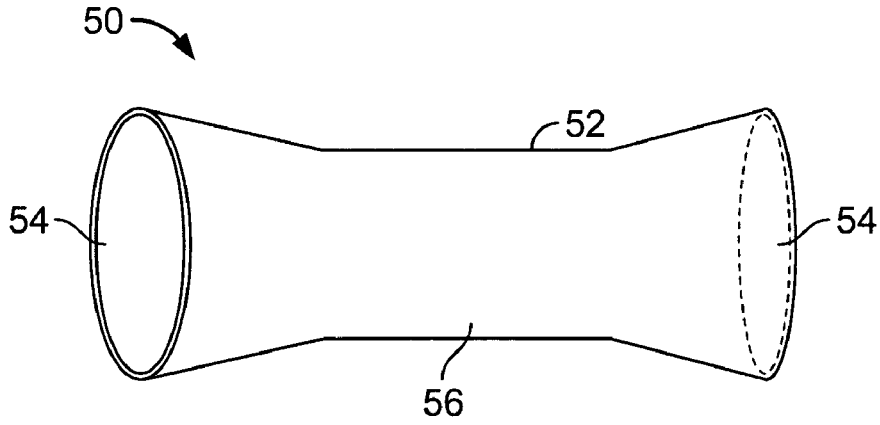
FIG. 3 is a perspective view of an implementation of a cable retainer.

Cable retainer 24 includes an elongated body 30 that defines a cavity 31 and one or more (as shown, two) openings 32 sized to receive cable 28 in a folded or bundled state. As shown, cavity 31 is configured to accommodate one cable 28 in a bundled state without causing excessive stress on the cable yet provides enough retention force to keep the cable in place during transport; but in other implementations, cavity 31 can be formed to accommodate multiple cables. Openings 32 are constantly exposed to the user and maintained at a size sufficient to receive cable 28. In some implementations, openings 32 have an average inner width, W, (or inner diameter, in implementations in which the openings are circular) of from about 1.5 inches to about 3 inches. Openings 32, which can have the same or different average widths or diameters, can be formed of any shape, such as circular or non-circular (e.g., oval, curvilinear, regularly polygonal, or irregularly polygonal). Openings 32 can be wider than other cross sections of the cable retainer (e.g., as shown in FIG. 3 described below). The length, L, of elongated body 30 is sufficient to support cable 28 so that a stowed cable does not flop excessively or fall out of retainer 24, for example, when medical device 22 is being transported. In some implementations, the length, L, is between about 8 inches and about 12 inches, inclusive. Expressed another way, in some implementations, cable retainer 24 has a length to inner width ratio (L/W) of from about 2:1 to about 8:1, preferably from about 2.5:1 to about 6:1. The width (W) and length (L), as used herein, refer to the width and the length of cable retainer 24 without a cable in the retainer.

Indeed, in some implementations, cable retainer 24 is formed such that it can deform in shape (e.g., width and/or volume) to receive cable 28. For example, retainer 24 can be formed of a compliant and resilient material that stretches to accommodate cable 28 during use. When a bundled cable is stored in the retainer, the expansive recoil of the bundled cable counteracts the elasticity of the resilient material to secure the cable in the retainer. The elasticity of the resilient material can be, for example, from about 0.25 lb/in to about 0.5 lb/in. Examples of resilient materials include rubbers (neoprene) and other thermoplastic elastomers (such as santoprene). The materials can have a hardness of from about 30 to about 70 Shore A. In some implementations, the surface of the resilient material that contacts the cable can include or be treated (e.g., coated) with a material to enhance friction between the cable and the cable retainer, thereby enhancing securement of the cable in the retainer. The exterior surface of the cable retainer can be treated (e.g., with Scotchguard® repellant) to resist staining and facilitate cleaning.

Figure 2:
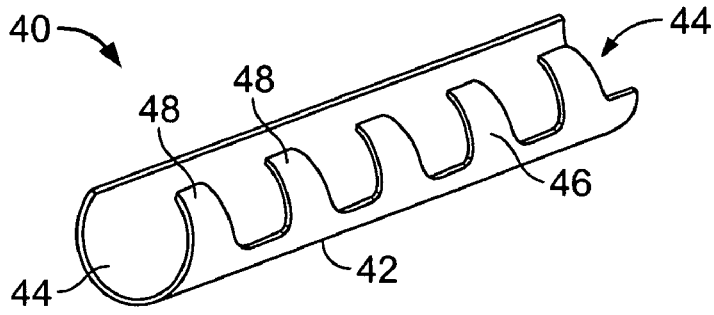
FIG. 2 is a perspective view of an implementation of a cable retainer.

In other implementations, cable retainer 24 may be formed of a relatively non-resilient material (e.g., less resilient than the resilient materials described above) but still designed to receive and to hold cable 28. For example, referring to FIG. 2, a cable retainer 40 has the form of a tubular member 42 including opening 44 and a wall portion 46 having tines 48. The design of tubular member 42 and the selection of the relatively rigid material allow openings 44 to be constantly exposed and maintained at a size sufficient to receive cable 28. At the same time, tubular member 42 is capable of resiliently flexing to receive and to accommodate cable 28 in retainer 40, and flexing back to secure the cable.

As another example, referring to FIG. 3, retainer 50 may have the form of a tubular member 52 including two openings 54 that taper to a narrower middle portion 56 of the tubular member. The wider openings 54 allow a bundled cable to be inserted into retainer 50 to the narrower middle portion 56 where, upon release of the bundled cable, the recoil of the cable secures the cable in the retainer. Examples of non-resilient materials that can be used include polymers (such as acrylonitrile butadiene styrene (ABS), polypropylene, polyurethane with a hardness of greater than about 70, and polyvinyl chloride (PVC)) and metals (such as aluminum and stainless steel). The non-resilient materials can be treated to enhance friction and/or to facilitate cleaning, as described above. In some implementations, the non-resilient material is overmolded with a thermoplastic elastomer.

Figure 4A:
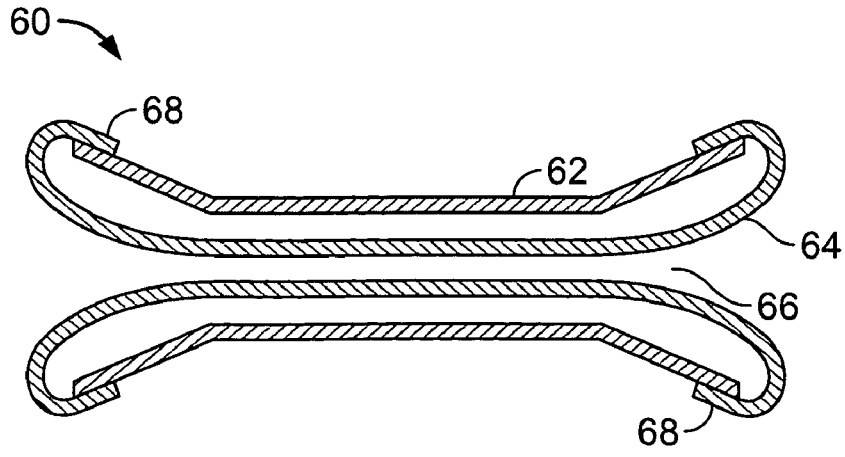
FIG. 4A is a cross-sectional view of an implementation of a cable retainer.
Figure 4B:
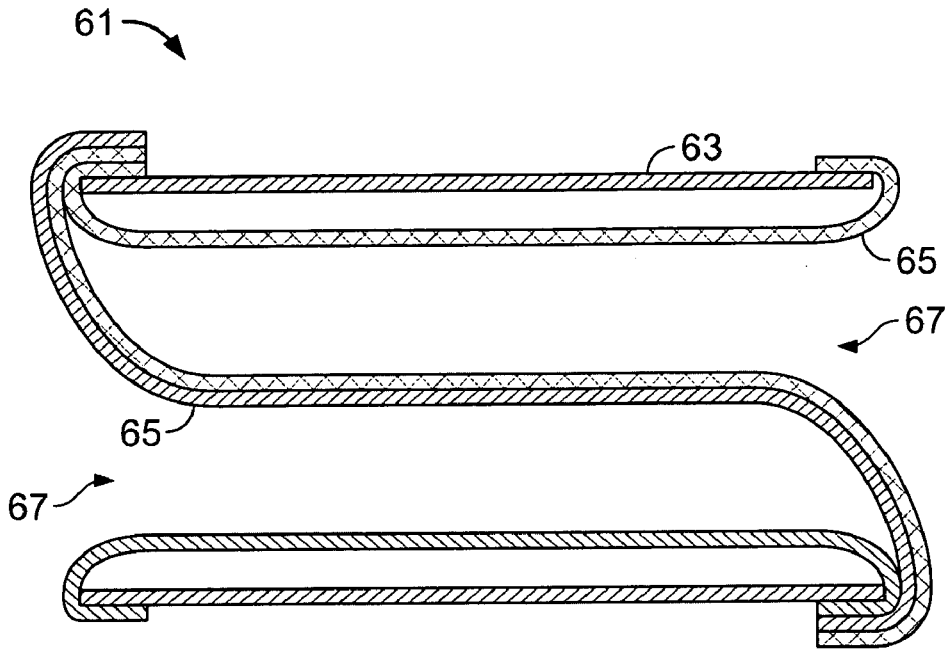
FIG. 4B is a cross-sectional view of an implementation of a cable retainer.

In still other implementations, a cable retainer is formed of a combination of a resilient material and a rigid, non-resilient material. Referring to FIG. 4A, a cable retainer 60 includes a rigid tubular member or sleeve 62, as shown, generally the same as tubular member 52, and a resilient tube 64 coaxial with tubular member 62. Resilient tube 64 (e.g., made of neoprene, woven nylon, or spandex) is stretched to define an elongated cavity 66 that extends the length of tubular member 62, and two ends 68 that are stretched to extend over the openings of tubular member 62 and secured to the tubular member. Thus, rigid tubular member 62 provides structural support for resilient tube 64 and maintains the ends of the resilient tube open. When a cable is inserted into retainer 60, resilient tube 64 is capable of expanding to accommodate and secure the cable in the retainer. Resilient tube 64 and rigid tubular member 62 can include one or more of the resilient materials and rigid materials, respectively, as described above. In other implementations, a cable retainer may include a rigid tubular member or sleeve supporting more than one resilient tube. Referring to FIG. 4B, a cable retainer 61 includes a rigid tubular member or sleeve 63, and two resilient tubes 65 that are stretched along and supported by the tubular sleeve. Each resilient tube 65 has one end secured to an end of tubular sleeve 63, and another end extending over and secured to another end of the tubular sleeve so as to form an opening 67. As a result, two cables can be inserted into cable retainer 61, one cable through each opening 67. The cable retainers described herein can be manufactured using conventional techniques. A cable retainer formed of a rigid material can be made, for example, by molding techniques, such as injection molding, or extrusion techniques, or by cutting (e.g., die cutting) an appropriate pattern of material and joining opposing ends (e.g., with snaps 33 as shown in FIGS. 1A and 1B) of the pattern to form cavity 31. During manufacture, the cable retainers can be fitted with attachments that mate with attachments in the medical system.

Medical device 22 can be any device capable of providing a therapeutic function and/or a monitoring function. Examples of medical devices include defibrillators, patient monitors, ultrasound units, ECG carts, intravenous pumps, and external pacemakers. Medical device 22 can be a standalone device or a device that is used in an assembly with other devices, such as medical monitors (e.g., ECG, SPO2, and ETCO2 monitors). Device 22 can be mobile (e.g., on a cart, a trolley, a wheelchair, an IV pole, or a bed, or a gurney) or fixed (e.g., mounted on a wall or a ceiling).

Cable 28 is generally configured to connect to medical device 22 to perform a therapeutic function and/or a monitoring function. In some implementations, cable 28 is a single trunk cable about 6 to about 10 feet long that may be folded 6 to 10 times to form a one-foot long bundle. Examples of cables include a twelve-lead, single trunk ECG cable with multiple leadwires, and a single cable/tube NIBP air hose. Another example of a cable is described in commonly assigned U.S. Ser. No. 11/054843 , entitled "Medical Cable" and filed concurrently with this application.

In use, the cable retainer may be installed in a medical system at a location at which the cable(s) can be conveniently inserted into and deployed from the retainer. For example, in implementations in which the medical device is mobile (e.g., placed on a cart) or used in an assembly that includes other medical devices, the cable retainer can be installed on the cart or another location so that it is clear to a user that a particular cable is associated with a particular medical device. In some implementations, the cable retainer is secured directly to a medical device, such as to its housing. The cable retainer can be irremovably secured to the medical device or removably secured to the device, for example, to facilitate cleaning and/or replacement. A cable can be inserted into a retainer by gathering the cable and folding the cable into a bundle. The bundle is then slidably inserted into an opening of the retainer, e.g., to overcome the elastic force of the retainer, and released. When the bundle expansively recoils, the cable is secured in the retainer, aided, in some implementations, by the elastic force of the resilient material of the retainer.

Many other implementations other than those described above are within the invention, which is defined by the following claims. As mentioned earlier, it is not possible to describe here all possible implementations of the invention, but a few possibilities not mentioned above include the following.

Figure 5:
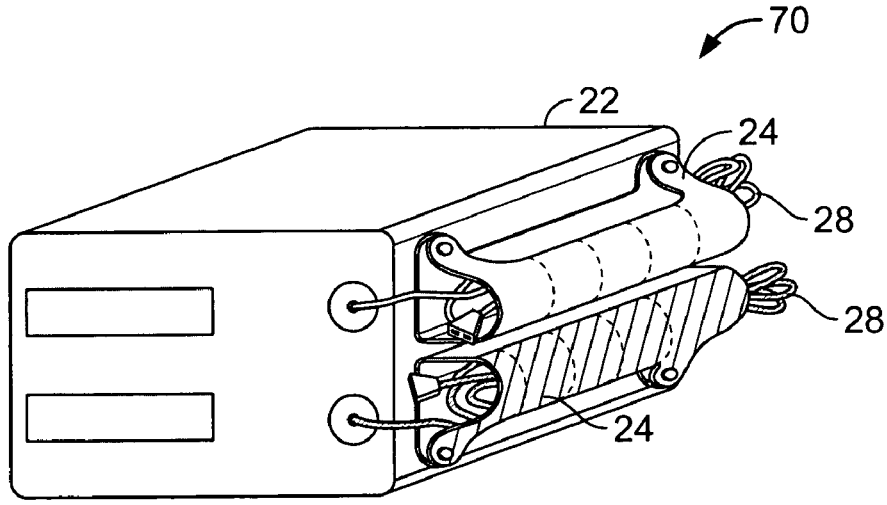
FIG. 5 is a perspective view of an implementation of a medical system.

While medical system 20 is described above having one cable retainer 24, in other implementations, e.g., as shown in FIG. 5, a medical system 70 may include a plurality of cable retainers 24 to accommodate multiple cables 28. The cable retainers may be placed close to each other (e.g., juxtaposed), or spaced from each other. The cable retainers may include indicia, such as a color-coding scheme or a label, that identify the cable that corresponds to the particular retainer. As a result, the cables can be organized and stowed in their intended retainers (e.g., for good fit and securement), and the cables can be more quickly accessed during use.

Figure 6:
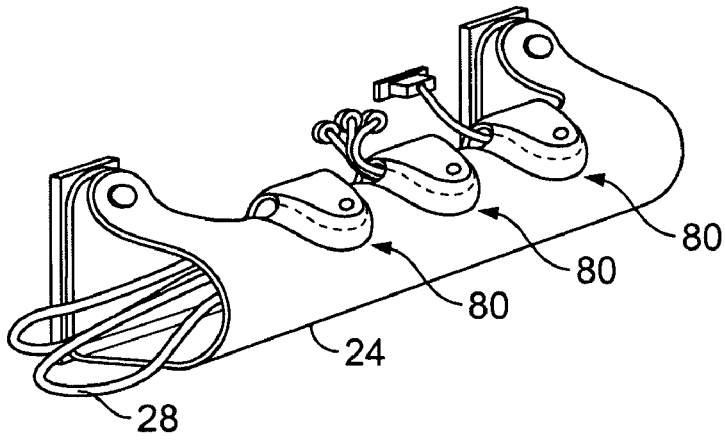
FIG. 6 is a perspective view of an implementation of a cable retainer.

Referring to FIG. 6, in some implementations, one or more cable retainers of a medical system may include one or more storage compartments 80, as shown, carried by and secured to the cable retainer. Compartments 80 may be used to store accessories, such as spare electrodes, additional sensor cables (e.g., ECG and SPO2 leads), extra paper, spare batteries, and smaller cables. In some implementations, the compartments may be removably secured to the cable retainer, for example, using hook-and-loop fasteners, so that compartments of different sizes and/or design can be organized according to a predetermined need.

The retainers need not be continuously solid, but may include openings or perforations so as to make the cable more visible.

The retainers need not be uniform in size, as exemplified by the implementation shown in FIG. 3.

A retainer formed of a non-resilient material may include a mechanism, such as a spring-loaded hinge, to enhance resiliency. For example, cable retainer 40 (FIG. 2), cable retainer 50 (FIG. 3), and tubular sleeve 63 (FIG. 4B) may include a spring-loaded hinge to enhance the retention force of the retainer or sleeve.

In some implementations, a retainer may include only one open end.

Figure 7:
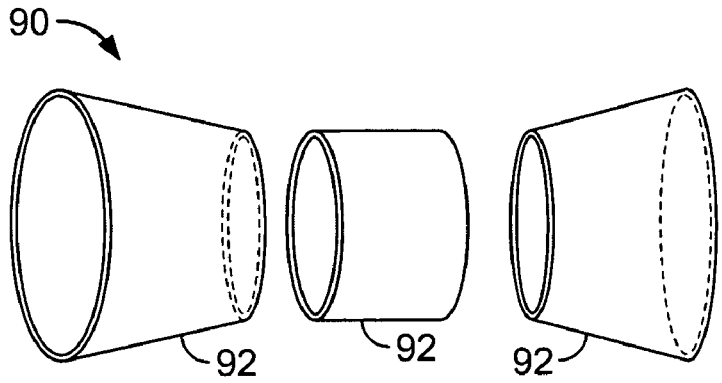
FIG. 7 is a perspective view of an implementation of a cable retainer.

Referring to FIG. 7, a cable retainer 90 may be formed of multiple (as shown, three) cable retainers 92 placed in series such that their openings are coaxial.

Figure 8:
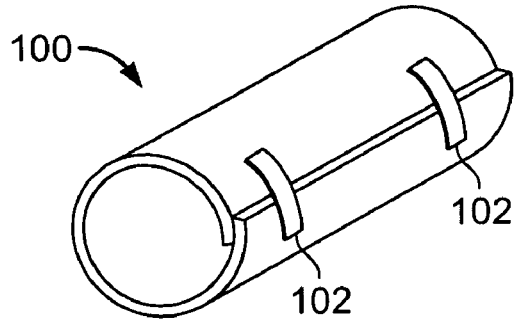
FIG. 8 is a perspective view of an implementation of a cable retainer.

In some implementations, a cable retainer may have a volume that is variable, or one or more openings that are adjustable in size, for example, to accommodate cables of different sizes. Referring to FIG. 8, a cable retainer 100 has the form of a sleeve including overlapping portions that are secured together with fasteners 102, such as hook-and-loop fasteners. The volume of retainer 100 and size of the end openings (e.g., inner diameters) can be increased or decreased by changing the amount of overlap between the portions. Retainer 100 may include a resilient material or a non-resilient material.

Not all of the features described above and appearing in some of the claims below are necessary to practicing the invention. Only the features recited in a particular claim are required for practicing the invention described in that claim. Features have been intentionally left out of claims in order to describe the invention at a breadth consistent with the inventors' contribution. For example, although in some implementations, a cable retainer can have a constantly exposed opening maintained at a size sufficient to receive the cable, this feature is not required to practice the invention of some claims. Although in some implementations, a cable retainer is capable of deforming in shape to receive a cable and has a length to width aspect ratio of greater than about 2:1, these features are not required to practice the invention of some claims.

What is claimed is:

1. A medical system, comprising:

a medical device comprising: a housing, and a cable connectable to the housing; and a cable retainer associated with the medical device, the cable retainer having the form of a sleeve having a length to width aspect ratio greater than or equal to about 2:1, the sleeve defining a constantly exposed opening maintained at a size sufficient to receive a bundle of folded lengths of the cable, the opening having a width and the length of the sleeve being measured along a longitudinal axis that extends generally perpendicular to a plane in which the width of the opening is measured, wherein held within the cable retainer at one time are a plurality of folded lengths of the cable.

2. The system of claim 1, wherein the cable retainer is capable of deforming in shape to receive the cable.

3. The system of claim 1, wherein the cable retainer is configured to retain the cable.

4. The system of claim 1, wherein the cable retainer comprises a resilient material.

5. The system of claim 3, wherein the resilient material is selected from the group consisting of a rubber and a thermoplastic elastomer.

6. The system of claim 1, wherein the aspect ratio is from about 2:1 to about 8:1.

7. The system of claim 1, wherein the cable retainer further comprises a second constantly exposed opening maintained at a size sufficient to receive the cable.

8. The system of claim 1, wherein the width of the opening is larger than another width of the cable retainer.

9. The system of claim 1, wherein the cable retainer is secured to the housing.

10. The system of claim 9, wherein the cable retainer is releasably secured to the housing.

11. The system of claim 1, further comprising a compartment associated with the cable retainer.

12. The system of claim 11, wherein the compartment is secured to the cable retainer.

13. The system of claim 1, wherein the cable retainer comprises a tubular member and a resilient material defining a cavity in the tubular member.

14. The system of claim 1, comprising a plurality of cable retainers associated with the medical device.

15. The system of claim 14, wherein the cable retainers comprise indicia corresponding to selected cables.

16. The system of claim 15, wherein the cable retainers are color-coded to selected cables.

17. The system of claim 1, wherein the medical device is capable of performing cardiac defibrillation.

18. A medical system, comprising:

a medical device comprising a housing, and a cable connectable to the housing; and a cable retainer associated with the medical device, the cable retainer the form of a sleeve having a length to width aspect ratio greater than or equal to about 2:1, the sleeve defining an opening having a width, and the length of the sleeve being measured along a longitudinal axis that extends generally perpendicular to a plane in which the width of the opening is measured, and the sleeve being capable of deforming in shape to receive a bundle of folded lengths of the cable, wherein held within the cable retainer at one time are a plurality of folded lengths of the cable, and wherein the bundle has a length to width aspect ratio greater than 2:1.

19. The system of claim 18, wherein the aspect ratio of the bundle is from about 2:1 to about 8:1.

20. The system of claim 18, wherein the cable retainer comprises a resilient material.

21. The system of claim 20, wherein the resilient material is selected from the group consisting of a rubber and a thermoplastic elastomer.

22. The system of claim 18,wherein the cable retainer further comprises a constantly exposed opening maintained at a size sufficient to receive the cable.

23. The system of claim 22, wherein the width of the opening is larger than another interior width of the cable retainer.

24. The system of claim 18, wherein the cable retainer is secured to the housing.

25. The system of claim 24, wherein the cable retainer is releasably secured to the housing.

26. The system of claim 18, further comprising a compartment associated with the cable retainer.

27. The system of claim 26, wherein the compartment is secured to the cable retainer.

28. The system of claim 18, wherein the cable retainer comprises a tubular member and a resilient material defining a cavity in the tubular member.

29. The system of claim 18, comprising a plurality cable retainers associated with the medical device.

30. The system of claim 29, wherein the cable retainers comprise indicia corresponding to selected cables.

31. The system of claim 30, wherein the cable retainers are color-coded to selected cables.

32. The system bf claim 18, wherein the medial device is capable of performing cardiac defibrillation.

* * * * *

UNITED STATES PATENT AND TRADEMARK OFFICE

CERTIFICATE OF CORRECTION

PATENT NO. : 7,530,840 B2
APPLICATION NO. : 11/055007
DATED : May 12, 2009
INVENTOR(S) : Peter A. Lund et al.

It is certified that error appears in the above-identified patent and that said Letters Patent is hereby corrected as shown below:

Column 8, line 52 claim 29, after “plurality”, insert -- of --.

Column 8, line 58 claim 32, “bf” should be -- of --.

Column 8, line 58 claim 32, “medial” should be -- medical --.

Signed and Sealed this

Fourth Day of August, 2009

JOHN DOLL
*Acting Director of the United States Patent and Trademark Office*